US006651674B2

(12) United States Patent
Ozaki et al.

(10) Patent No.: US 6,651,674 B2
(45) Date of Patent: Nov. 25, 2003

(54) HAIR HEATING DEVICE HAVING CONCENTRIC REVERSE REDUCTION GEARING

(75) Inventors: Shigetsugu Ozaki, Okazaki (JP); Shigechika Kobayashi, Okazaki (JP); Hirohisa Shimizu, Osaka (JP)

(73) Assignee: Oohiro Works Co., Ltd., Osaka (JP)

( * ) Notice: Subject to any disclaimer, the term of this patent is extended or adjusted under 35 U.S.C. 154(b) by 0 days.

(21) Appl. No.: 09/972,969

(22) Filed: Oct. 10, 2001

(65) Prior Publication Data

US 2002/0088472 A1 Jul. 11, 2002

(30) Foreign Application Priority Data

Jan. 9, 2001 (JP) ..... 2001-001018

(51) Int. Cl.[7] ..... A45D 7/02; A45D 20/08

(52) U.S. Cl. ..... 132/211; 132/271; 34/96; 607/109; 219/222

(58) Field of Search ..... 132/206, 207, 132/211, 212, 271; 392/412, 413, 414, 415; 34/266, 96, 97; 607/100, 109, 110, 91; 362/239, 428; 219/222

(56) References Cited

U.S. PATENT DOCUMENTS 1,667,775 A * 5/1928 Edmands ..... 219/525
4,910,382 A * 3/1990 Kakuya et al. ..... 219/222
4,914,273 A * 4/1990 Matsui ..... 219/222
5,010,604 A * 4/1991 Miller ..... 4/519
5,063,688 A * 11/1991 Moll et al. ..... 34/97
5,231,770 A * 8/1993 Fertig ..... 34/266
5,268,988 A * 12/1993 Miyamoto et al. ..... 392/380

FOREIGN PATENT DOCUMENTS

JP 10-113218 5/1998

* cited by examiner

*Primary Examiner*—Eduardo C. Robert
*Assistant Examiner*—David C Comstock
(74) *Attorney, Agent, or Firm*—Birch, Stewart, Kolasch & Birch, LLP

(57) ABSTRACT

A hair heating device for use with regard to a permanent wave, which may elevate the hair temperature in a uniform manner without applying an excessive amount of heat energy not only to the head at a time but also to the hair locally so that the hair may escape deterioration and discoloration, and a process for permanent or dyeing hair by the device. The hair heating device includes two swing arms in the form of an arch, which include heaters mounted on the inside thereof, a concentric reverse reduction gearing, and a motor for driving said gearing. The concentric reverse reduction gearing is provided with an output shaft member A and an output shaft member B arranged such that both the output shaft members may rotate in opposite directions. A transmission member of the swing arm is connected with the output shaft member A, while a second transmission member of the swing arm is connected with the output shaft member B. A process is provided for permanent or dyeing hair that may be carried out by applying heat to the hair using the hair heating device.

9 Claims, 6 Drawing Sheets

HAIR HEATING DEVICE HAVING CONCENTRIC REVERSE REDUCTION GEARING

BACKGROUND OF THE INVENTION

Although permanent wave does not absolutely need the application of heat to the hair, the heat treatment for hair is administered as needed because some hair may not be treated unless it is permed strongly, or waves or curls put in the hair may be needed to last longer. In addition, much time may not be desired to be taken for the permanent. Referring to hair-dyeing techniques, a process is employed for speeding up hair-dyeing by applying heat to the hair.

The present invention relates to a hair heating device for use in drying hair after being washed, perming or dyeing of the hair. Said hair heating device is intended for drying hair, speeding up perm or hair-dyeing, or finishing up a strong perm by means of heat treatment by swinging two arch-shaped swing arms having heaters thereinside from the original position to the lower end position until said heaters provided inside the two arch-shaped swing arms reach the vicinity of the shoulders from the top of the head.

Referring to conventional hair heating devices, a process is known for heating hair by moving a heater mounted on a donut-shaped flat plate over the head. Said process tends to apply heat to so large an area of the head that the head may receive an excess of heat energy, whereby persons having their hair permed are forced to be patient with the applied heat.

The intensity of heat energy to which the head is exposed varies with parts, some to a high and some to a low energy. An attempt to apply a certain amount of heat energy may cause deterioration or discoloration of hair in a part which has eventually been exposed to an excess of heat energy.

The Patent Application Laid-Open No. 10-113218 proposed an invention for a semi-circular reflective plate with a heater which may reciprocate from the front of head to the back of head. However, it remains a problem that such an inventive arrangement fails to secure uniformity in the elevation of the hair temperature.

With the recited invention, since the semi-circular reflective plate with the heater is adapted to apply heat as it moves alternately back and forth through an angle of 180 degrees, much time lapses until the next heating is resumed, so that hair in some part of the head may be lower in temperature.

In the making of this invention, the inventor has come up with a hair heating device wherein two swing arms in the form of an arch are driven by two motors through separate reduction gearing, but such a structure is problematic in that it may make the device complex and very large.

Another problem consists in the potential occurrence of a deviation of the two swing arms in position based on separate driving by the two motors. In this connection, the present invention provides that one of the two swing arms put in the original position and another in the lower end position can restart together simultaneously. However, if any one of the two has arrived at its destination before the other at its own, it must stay there for a while, which may cause a specific portion of the head to be exposed to an excess of heat energy.

SUMMARY AND OBJECTS OF THE INVENTION

The present invention has been made in order to eliminate the drawbacks of prior art and the disadvantage of the idea that two swing arms are designed to be driven by a couple of motors.

It is an object of the present invention to avoid imparting too much heat energy to the head at a time by swinging two arch-shaped swing arms each having a heater on the inside thereof between the original position and the lower end position so that the heaters provided on the inside of the two swing arms may heat the head locally in sequence from the top of the head to the vicinity of the shoulders.

It is a further object of the present invention to avoid any partial deterioration or discoloration of hair by applying heat energy to the hair uniformly while keeping a certain distance between the heaters and the hair so as to give no excess of heat energy locally.

It is yet a further object of the present invention to make the device simple, to prevent any deviation of the two swing arms in position and to avoid furnishing specific portions with heat energy to an excess by driving the two swing arms by means of a single motor.

The present invention provides a hair heating device comprising two arch-shaped swing arms each having heaters on the inside thereof, a concentric reverse reduction gearing, and a motor that may drive said gearing.

Said concentric reverse reduction gearing includes an output shaft member A and an output shaft member B, both members having the same center, and may act to reduce and transmit the number of revolutions of the force from the motor to the output shaft members A and B, and said output shaft members A and B rotate at the same speed in an opposite direction relative to each other.

The swing arms have a transmission member provided in one end thereof respectively. The transmission member of one of the swing arms is connected with the output shaft member A, while the transmission member of the other with the output shaft member B.

There is provided a support arm in the form of an arch outside of the two arch-shaped swing arms, which support arm having the concentric reverse reduction gearing mounted on one end thereof, and a driven shaft that supports the transmission members of the two arch-shaped swing arms on the other end thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
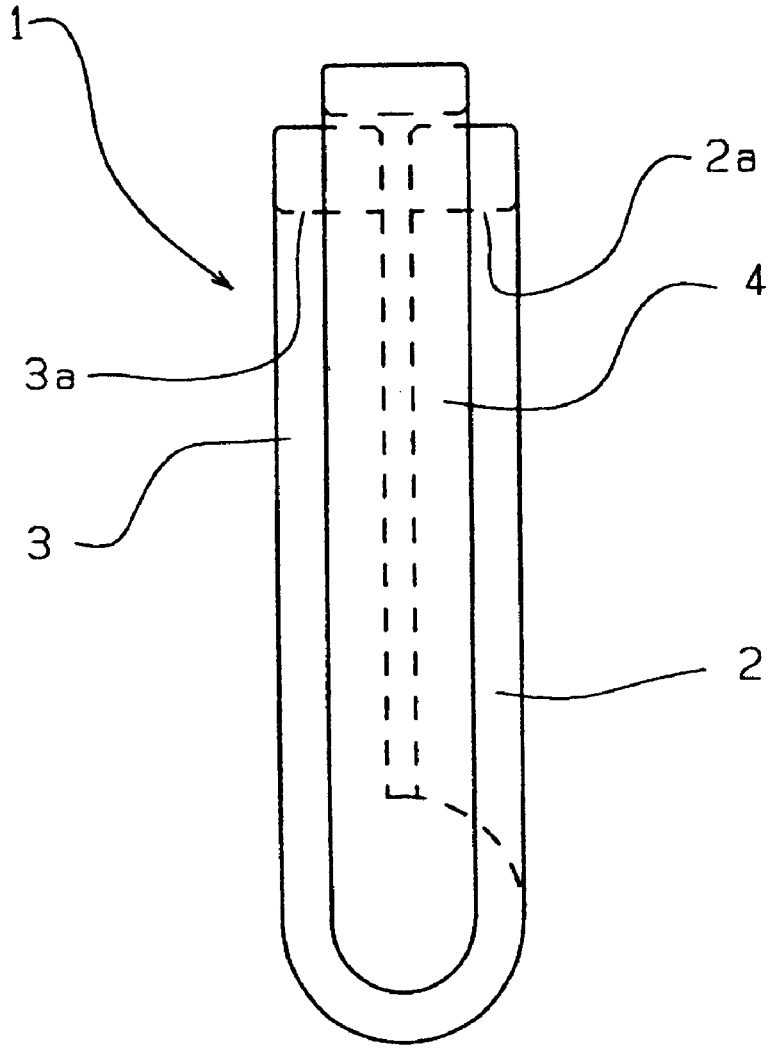
FIG. 1 is a front view of one embodiment of a hair heating device in accordance with the present invention.
Figure 2:
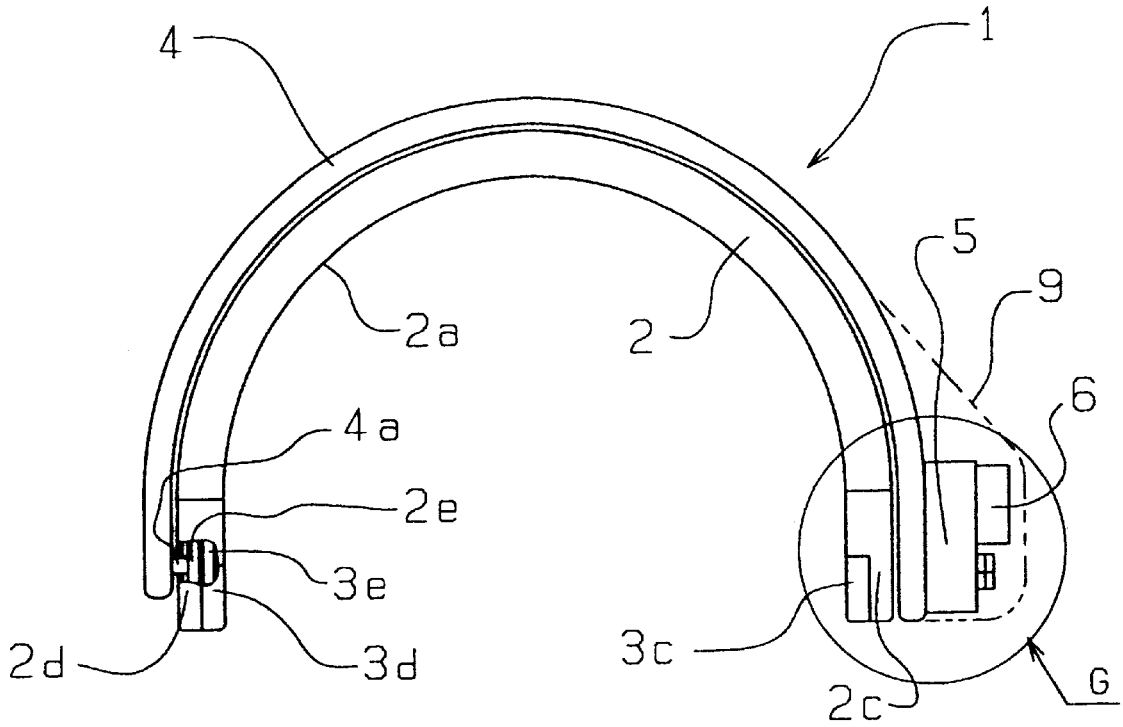
FIG. 2 is a side view of said embodiment of the hair heating device in accordance with the present invention.
Figure 3:
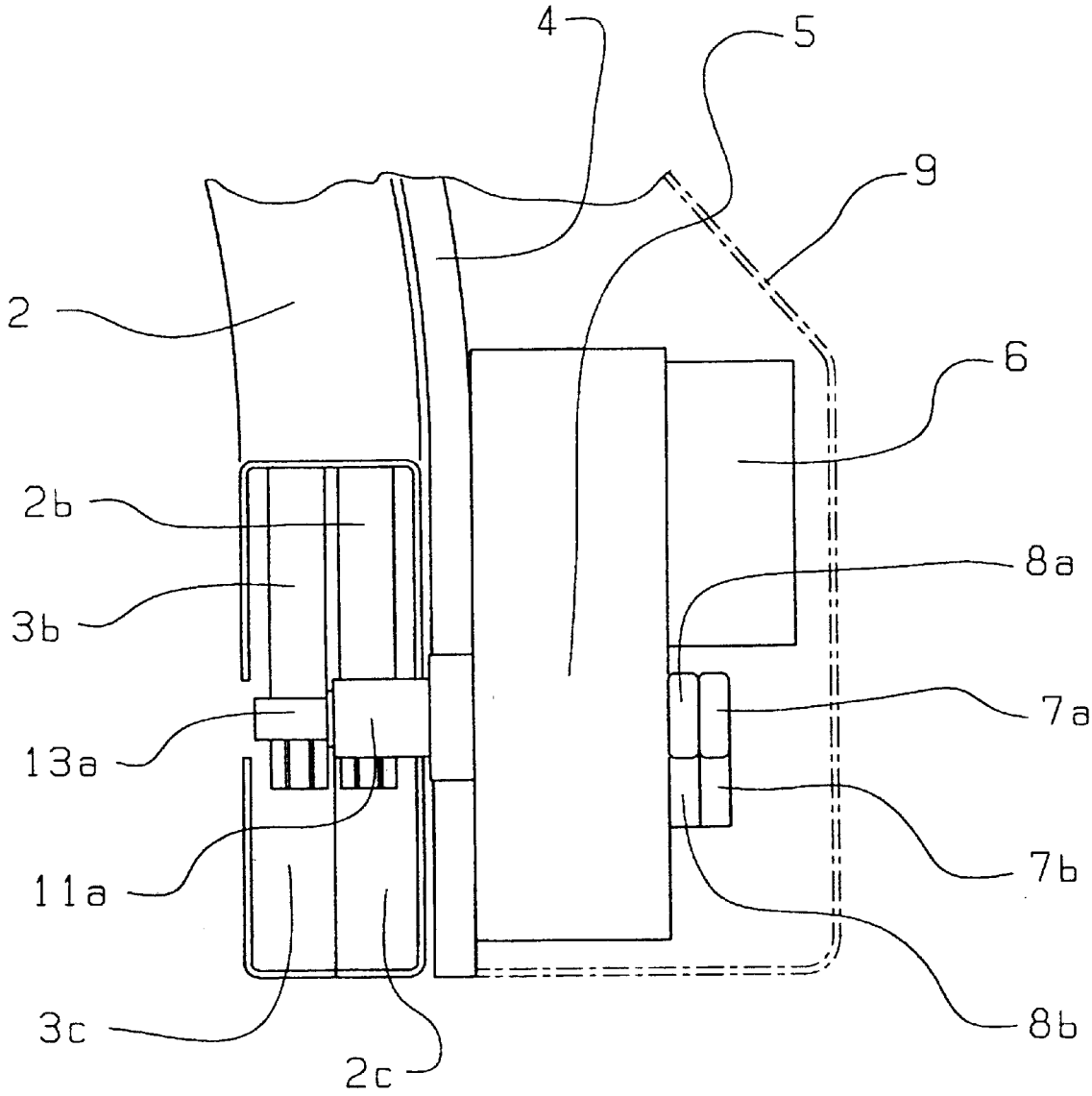
FIG. 3 is an enlarged cross sectional view of the portion G of FIG. 2.
Figure 4:
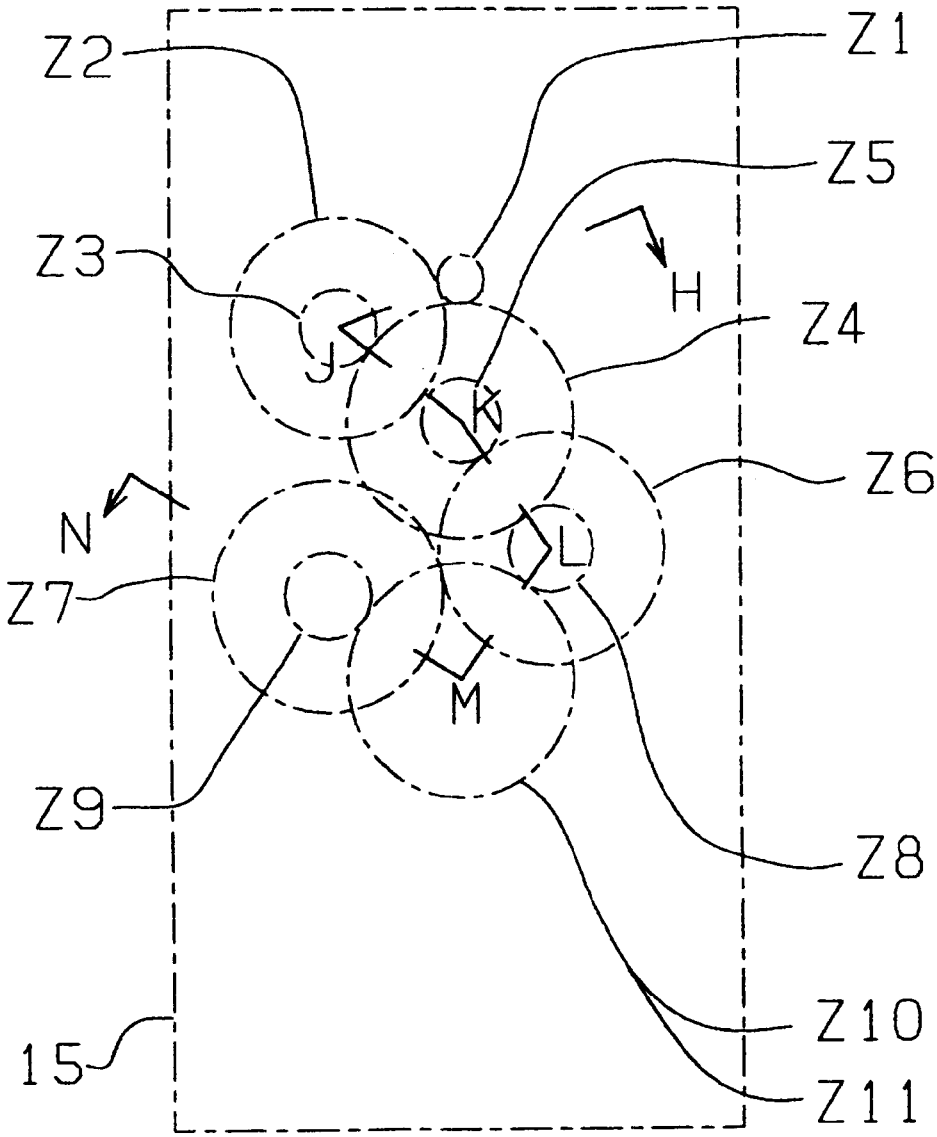
FIG. 4 is a view showing the arrangement of gears of one embodiment of the concentric reverse reduction gearing by a long and short dash line.
Figure 5:
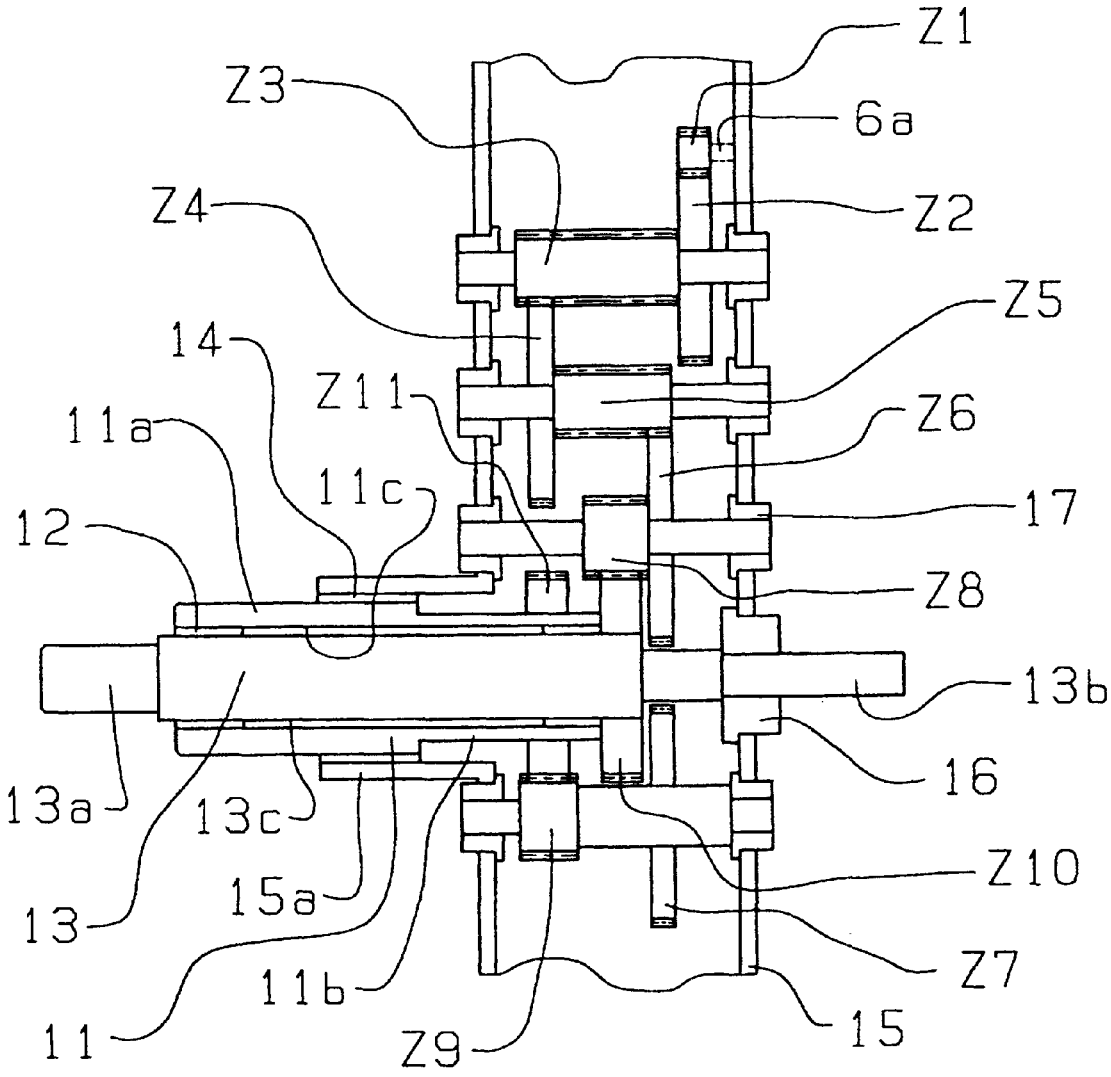
FIG. 5 is a cross sectional view on line of H-J-K-L-M-N of FIG. 4.
Figure 6:
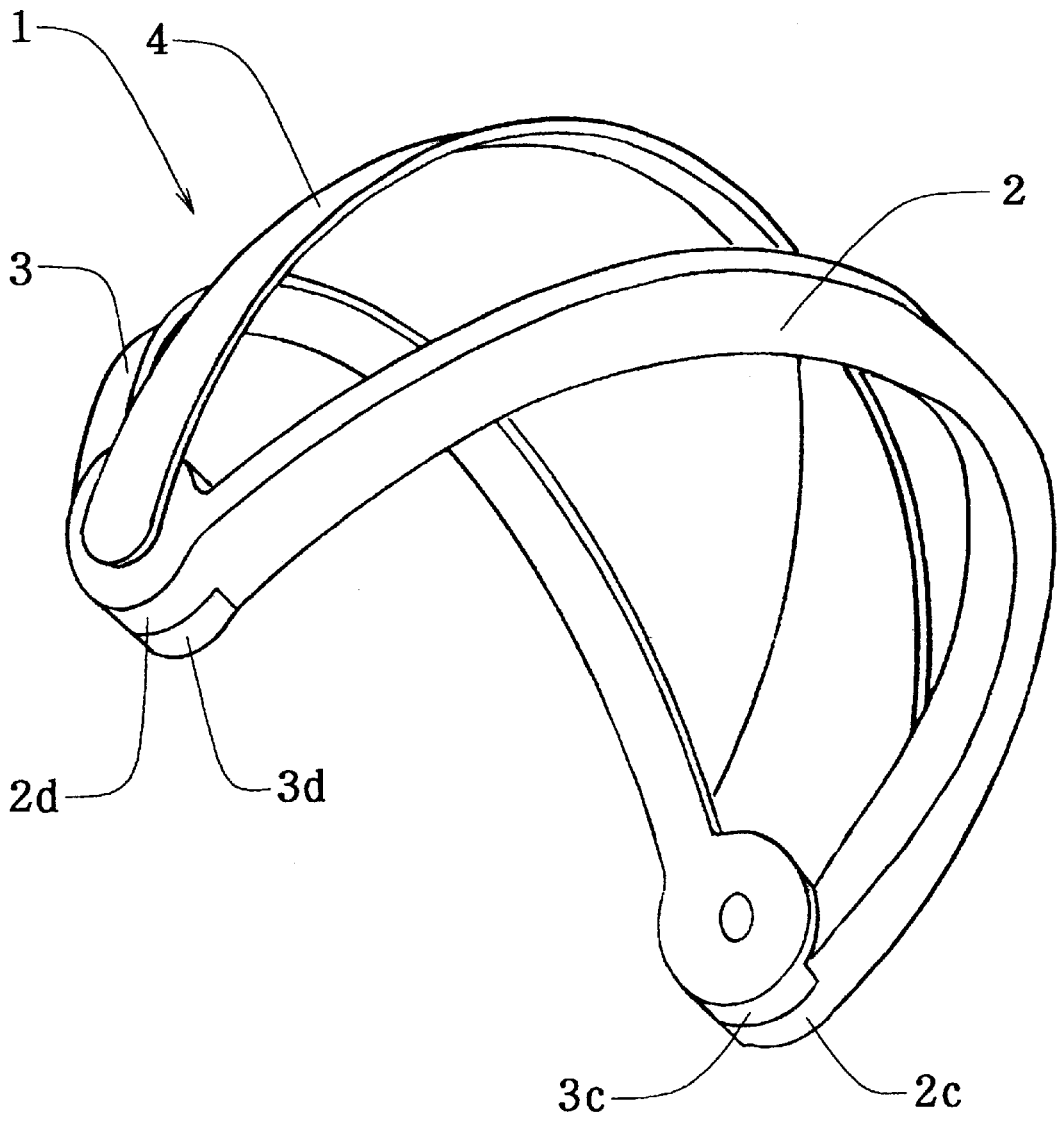
FIG. 6 is a perspective view of the hair heating device of one embodiment in accordance with the present invention in swing motion.

The embodiments of the present invention will be described with reference to the drawings. A hair heating device 1 in accordance with the present invention comprises two swing arms 2, 3, a concentric reverse reduction gearing 5, a motor 6, and a support arm 4. The support arm 4 has the concentric reverse reduction gearing 5 and the motor 6 mounted on the outside of one end thereof, and the driven shaft 4*a* in the inside of the other opposite end.

When viewed from the side, the swing arms 2, 3 are shaped like a semicircular arch in their centers, and a four-sided figure with round corners in cross section, and provided with heaters (not shown) on the inside thereof, respectively. The swing arms 2, 3 have transmission members 2*b*, 3*b* and driven members 2*e*, 3*e* attached on both ends thereof.

The transmission members 2*b*, 3*b* are securely connected by set bolts with an output shaft member A 11*a* and an output shaft members B 13*a* of said concentric reverse reduction gearing 5 respectively, while the driven members 2*e*, 3*e* of the swing arms 2, 3 are rotatably connected with the driven shaft 4*a* of the support arm 4 in such a manner that the output shaft members A 11*a* and B 13*a* of the concentric reverse reduction gearing 5 may be arranged in alignment with the driven shaft 4*a*. Additionally, the swing arms 2, 3 include transmission covers 2*c*, 3*c* and driven member covers 2*d*, 3*d* on both ends thereof respectively.

When viewed from the side, the central part of the support arm 4 is shaped like an semicircular arch constituted having a radius a little larger than that of each of the swing arms 2, 3, and a four-sided figure with round corners in cross section, so that the section to which the concentric reverse reduction gearing 5 is secured is made wider when viewed from the front.

The concentric reverse reduction gearing 5 is mounted such that the output shaft members A 11*a* and B 13*a* may look inward of the support arm 4, and that the motor 6 is mounted to a box 15 of the concentric reverse reduction gearing 5 in such a fashion that a gear Z1 mounted to the shaft 6*a* of the motor 6 may mesh with a gear Z2.

A detection shaft 13*b* formed integral with a shaft B 13 having the output shaft member B 13*a* of the concentric reverse reduction gearing 5 is arranged so as to protrude in a direction opposite to the output shaft member B 13*a*, whereby said detection shaft 13*b* may be provided with switching points or marks 7*a*, 8*a*, and sensors 7*b*, 8*b* as well. The concentric reverse reduction gearing 5, motor 6, etc. are covered with a cover 9.

A position as shown in FIG. 1, in which the swing arms 2, 3 are resting, is referred to as the original position. While in use, the swing arms 2, 3 are placed on the head of a user. A position near the user's shoulder to which the swing arms 2, 3 have come down from the head by rotary motion is referred to as the lower end position. The sensors 7*b*, 8*b* are adjusted so that it may detect the switching points or marks 7*a*, 8*a* at each of said positions.

Combinations of gears (Z2 and Z3), (Z4 and Z5), (Z6 and Z8), and (Z7 and Z9) are mounted on four shafts supported by a bearing 17 within the box 15 of the concentric reverse reduction gearing 5 respectively. A gear Z11 is mounted on the small-diameter portion 11*b* of the shaft A 11 having the output shaft A 11*a*, and a gear Z10 on the shaft B 13 having the output shaft member B 13*a*. Here, (Z6 and Z7), (Z8 and Z9), and (Z10 and Z11) are all gears having the same number of teeth.

(Z1×Z2), (Z3×Z4), (Z5×Z6), (Z8×Z10) and (Z6×Z7), (Z9×Z11) are meshing combinations, and all of the combinations except for (Z6×Z7) are intended for reduction of the rotary speed.

The shaft A 11 having the output shaft member 11*a* is shaped like a cylinder, and the shaft B 13 having the output shaft member B 13*a* is shaped like a round bar. The shafts A 11 and B 13 are arranged in alignment with each other, and there are provided two bearings 12 in a gap between the inside 11*c* of the shaft A 11 and the outside 13*c* of the shaft B 13. The shaft A 11 is maintained on a bearing holder 15*a* via the bearing 14, while the shaft B 13 is maintained in the box 15 via the bearing 16 in the detection shaft 13*b*.

The action of the present invention thus arranged will be explained in the following. A combination unit of the shafts A 11 and B 13 is held by the two bearings 14, 16, and two bearings 12 are provided between the shafts A 11 and B 13, whereby the shafts A 11 and B 13 are held so that they may rotate relative to each other.

The turning effort of the shaft 6*a* of the motor 6 may drive the shaft B 13 with slower speeds under the influence of the combinations of gears, as (Z1×Z2), (Z3×Z4), (Z5×Z6), and (Z8×Z10).

On the other hand, the gear Z6 is not only driven by the gear Z5 but also may simultaneously drive the gear Z7 in turn, and the gear Z9 drives the gear Z11. As the gears Z6 and Z7, Z8 and Z9, Z10 and Z11 are the same in the number of teeth, the shafts A 11 and B 13 rotate in opposite directions at the same speed.

The hair heating device 1 in accordance with the present invention is intended for use in drying hair after being washed, or treatment after the application of chemicals for a permanent or hair-dyeing. The hair heating device is positioned on the head with the driven member covers 2*d*, 3*d* of the swing arms 2, 3 placed in front of the forehead and the transmission covers 2*c*, 3*c* disposed behind the back of the head.

When the motor 6 is put in motion while the hair is heated by means of infrared radiation from the heaters, the swing arms 2, 3 start swinging down from the original position. When the swing arms 2, 3 run from the top of the head past the side of the face down to the vicinity of the shoulders, the sensor 8*b* may detect that the switching point or mark 8*a* has reached the lower end position, and the swing arms 2, 3 comes to a halt. It is preferable that the operation stop at this stage when light heating is needed.

For further application of heat, the motor 6 is reversed, then the swing arms 2, 3 leave the lower end position to go up to the top of the head via the side of the face, then the sensor 7*b* senses the arrival of the switching point or mark 7*a* at the original position, and the operation stops. In general, often the swing arms are put in frequent reciprocating motion for hair heating.

Referring to the method of supporting the present hair heating device, since this device is ordinarily used for a customer sitting on a chair in a beauty parlor, it may be supported by a bracket protruding from the side or the rear of the chair, or a support having legs with casters. The method is not restricted to the above-mentioned.

Different combinations of gears of said concentric reverse reduction gearing are available for deceleration purpose.

Without restriction to said embodiments, any type of reduction gearing may be used in which the speed of input rotary motion can be slowed down, the two output shafts are concentric with each other, and rotate at the same speed in opposite directions.

For further effect, each of the swing arms can swing through 90 degrees for its service area, so any partial decrease of hair temperature which may occur during the reciprocation of the swing arms can be prevented, whereby the hair temperature can be elevated in a uniform manner.

In said embodiment, the arched forms of the two swing arms and support arm are made by a combination of an arc and a straight line, but the form of said arms is not necessarily restricted to said embodiment. This is because any other form of an arch, such as parabola or ellipse, is proper provided that it is akin to the profile of a human head.

In said embodiment, the pivot of the two swing arms is positioned on a line extending between the forehead and the back of the head. A variation can be conceived wherein while the pivot of the two swing arms is arranged in parallel with a line running between the left and right ears, the position in which one of the two swing arms is close to the forehead and the other one to the nape of the neck is referred to as a lower end position, and the intermediate position between the forehead and the nape as an original position. Said embodiment is not always adhered to.

In accordance with the hair heating device provided by the present invention, by swinging the two arch-shaped swing arms from the original position to the lower end position, the heaters mounted on the insides of the two swing arms may act to apply heat to hair from the top of the head down to the vicinity of the shoulders in sequence rather than providing an excessive amount of heat energy to the head at a time.

Referring to one of the effects of the present invention, the uniform application of heat energy while keeping a certain clearance between the heaters and the hair may avoid any local supply of an excess of heat energy, thus resulting in no partial deterioration and discoloration of hair.

Additionally, the use of a single motor for the drive of the two swing arms could give rise to an effect that the device can be made simple in structure, and prevent any deviation of the two swing arms one from another in position and partial application of an excessive amount of heat energy.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hair heating device comprising:

two arch-shaped swing arms;

a heater operatively mounted relative to each of said arch-shaped swing arms;

a concentric reverse reduction gearing; and a motor for driving said gearing;

wherein said concentric reverse reduction gearing is arranged with two output shafts (output shaft member A and output shaft member B) having the same center respectively and said output shafts may rotate at substantially the same speed in opposite directions, and said two swing arms have transmission members provided on the ends thereof, said transmission members being coupled to said two output shafts respectively.

2. The hair heating device as defined in claim 1, wherein a support arch is provided outside of said two swing arms in the form of an arch, the concentric reverse reduction gearing is mounted on one end of said support arm in such a manner that the output shaft members A and B may look toward the inside of said arch-shaped support arm, and a driven shaft is mounted inside of the other end of said support arm, and wherein the transmission members of said two swing arms are connected to the output shaft members A and B of said concentric reverse reduction gearing respectively, and the driven member is provided on the end opposite to the ends on which said transmission members of said two swing arms has been mounted, said driven member being supported by said driven shaft as mounted on said support arm, so that said output shaft member A, said output shaft member B and said driven shaft may be positioned in alignment with each other.

3. The hair heating device as defined in claim 1 or 2, wherein a shaft A having the output shaft member A of the concentric reverse reduction gearing is cylindrical, the shaft A and shaft B being mounted concentric with each other, and a bearing being provided in a gap formed between an inside of the shaft A and an outside of the shaft B.

4. The hair heating device as defined in claim 3, wherein a part of the shaft B of said concentric reverse reduction gearing that projects on the opposite side of the output shaft member B provides a detection shaft member, which may detect the original position and the lower end position of the swing arms by detecting a switching point or mark as formed on said detection shaft member with a sensor.

5. A hair treatment process comprising the following steps:

placing a hair heating device on a head of an individual after the application of chemicals for permanent wave or hair-dyeing to an individual's hair, said hair heating device being provided with two arch-shaped swing arms having heaters, operatively mounted relative thereto, said swing arms being connected with an output shaft member of a concentric reverse reduction gearing at one end of said swing arms through a transmission member to swing in opposite directions, and swinging said two swing arms of said hair heating device from the original position to the lower end position, so as to apply heat to the hair in sequence from the top of the head down to the vicinity of the shoulders by means of said heaters, whereby permanent wave or hair-dyeing treatment may be selectively completed.

6. A hair heating device comprising:

two arch-shaped swing arms;

a heater operatively mounted relative to each of said arch-shaped swing arms;

a reverse reduction gearing; and a motor for driving said gearing;

wherein said reverse reduction gearing is arranged with two output shafts (output shaft member A and output shaft member B) respectively and said output shafts may rotate at substantially the same speed in opposite directions, and said two swing arms have transmission members provided on the ends thereof, said transmission members being coupled to said two output shafts respectively.

7. The hair heating device as defined in claim 6, wherein a support arch is provided outside of said two swing arms in the form of an arch, the reverse reduction gearing is mounted on one end of said support arm wherein the output shaft members A and B are positioned toward the inside of said arch-shaped support arm, and a driven shaft is mounted inside of the other end of said support arm, and wherein the transmission members of said two swing arms are connected to the output shaft members A and B of said reverse reduction gearing respectively, and the driven member is provided on the end opposite to the ends on which said transmission members of said two swing arms has been mounted, said driven member being supported by said driven shaft as mounted on said support arm, so that said output shaft member A, said output shaft member B and said driven shaft may be positioned in alignment with each other.

8. The hair heating device as defined in claim 6 or 7, wherein a shaft A having the output shaft member A of the reverse reduction gearing is made cylindrical, the shaft A and shaft B being mounted concentric with each other, and a bearing being provided in a gap formed between an inside of the shaft A and an outside of the shaft B.

9. The hair heating device as defined in claim 8, wherein a part of the shaft B of said reverse reduction gearing that projects on the opposite side of the output shaft member B provides a detection shaft member, which may detect the original position and the lower end position of the swing arms by detecting a switching point or mark as formed on said detection shaft member with a sensor.

* * * * *